United States Patent [19]

Tyree, Jr.

[11] 4,211,085

[45] Jul. 8, 1980

[54] SYSTEMS FOR SUPPLYING TANKS WITH CRYOGEN

[76] Inventor: Lewis Tyree, Jr., 145 Briarwood Ave., North, Oak Brook, Ill. 60521

[21] Appl. No.: 924,685

[22] Filed: Jul. 14, 1978

Related U.S. Application Data

[63] Continuation-in-part of Ser. No. 737,440, Nov. 1, 1976, Pat. No. 4,127,008, and a continuation-in-part of Ser. No. 737,439, Nov. 1, 1976, Pat. No. 4,100,759.

[51] Int. Cl.[2] ..... F17C 7/02

[52] U.S. Cl. ..... 62/48; 62/239; 62/165; 62/514 R

[58] Field of Search ..... 62/45, 48, 62, 165, 62/239, 514 R, 54, 55

[56] References Cited

U.S. PATENT DOCUMENTS

| | | | |
|---|---|---|---|
| 3,303,660 | 2/1967 | Berg | 62/54 |
| 3,369,371 | 2/1968 | Holly et al. | 62/54 |
| 3,810,365 | 5/1974 | Hampton et al. | 62/48 |
| 3,984,993 | 10/1976 | Muska | 62/45 |
| 3,994,141 | 11/1976 | Schräwer | 62/514 R |

*Primary Examiner*—Ronald C. Capossela
*Attorney, Agent, or Firm*—Fitch, Even & Tabin

[57] ABSTRACT

A system for filling transportable tanks with a cryogen, such as low pressure liquid carbon dioxide. A holding chamber is supplied with liquid $CO_2$ from a storage vessel system, and the pressure of liquid $CO_2$ is reduced to the triple point to create $CO_2$ snow and form a low-temperature coolant reservoir. $CO_2$ vapor from the chamber is compressed and returned to the storage vessel system. Liquid $CO_2$ can be supplied simultaneously to the tanks of several vehicles at below about 125 psig, and vapor from these tanks is promptly condensed by melting $CO_2$ snow in the holding chamber. Standby cooling of vehicle cargo compartments can also be effected with recovery of the $CO_2$ vapor using an auxiliary compressor.

10 Claims, 3 Drawing Figures

SYSTEMS FOR SUPPLYING TANKS WITH CRYOGEN

This application is a continuation-in-part of my earlier copending applications Ser. Nos. 737,439, now U.S. Pat. No. 4,100,759 and 737,440, now U.S. Pat. No. 4,127,008, both filed Nov. 1, 1976.

This invention relates generally to cryogenically cooled transportable refrigeration systems, and more specifically to an arrangement for efficiently and economically filling the tanks of refrigerated vehicles and the like with liquid carbon dioxide.

Although both mechanical and cryogenic systems have been developed in the past for cooling refrigerated vehicles and the like, the industry has continued to search for better and improved versions. For example, U.S. Pat. No. 3,802,212, issued Apr. 9, 1974 and U.S. Pat. No. 3,374,640, issued Mar. 26, 1968 illustrate the use of liquid nitrogen cooling units for refrigerated vehicles. My copending application Ser. No. 708,268, filed July 23, 1976, now U.S. Pat. No. 4,045,972, illustrates a cryogenic vehicle cooling system utilizing liquid carbon dioxide which is believed to have significant advantages over prior art cooling systems of their general type.

Figure 1:
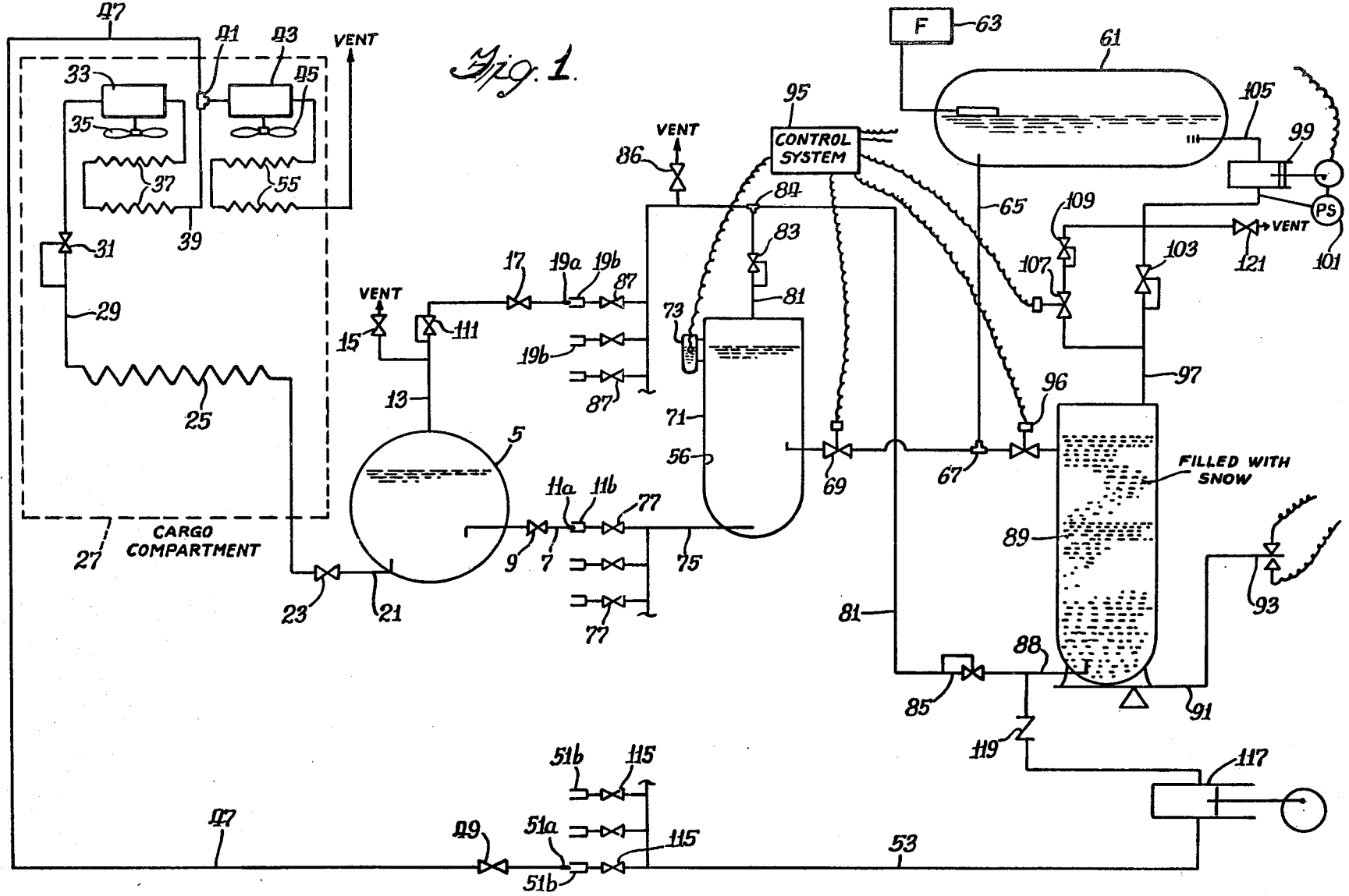
Figure 2:
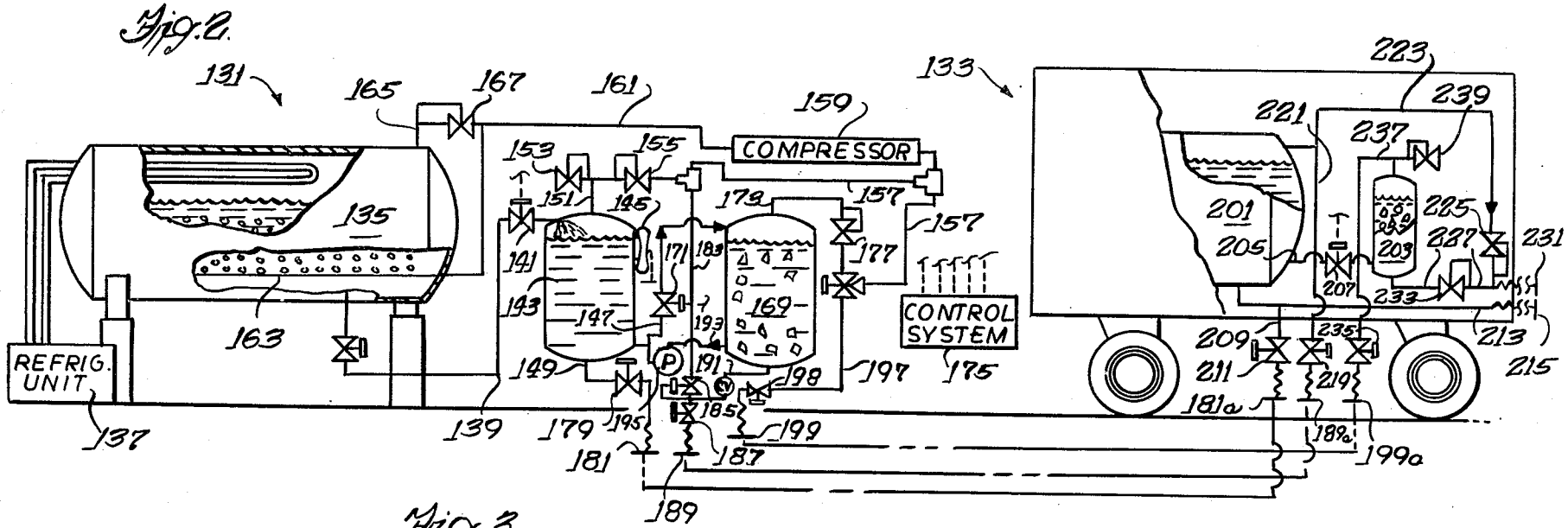
Figure 3:
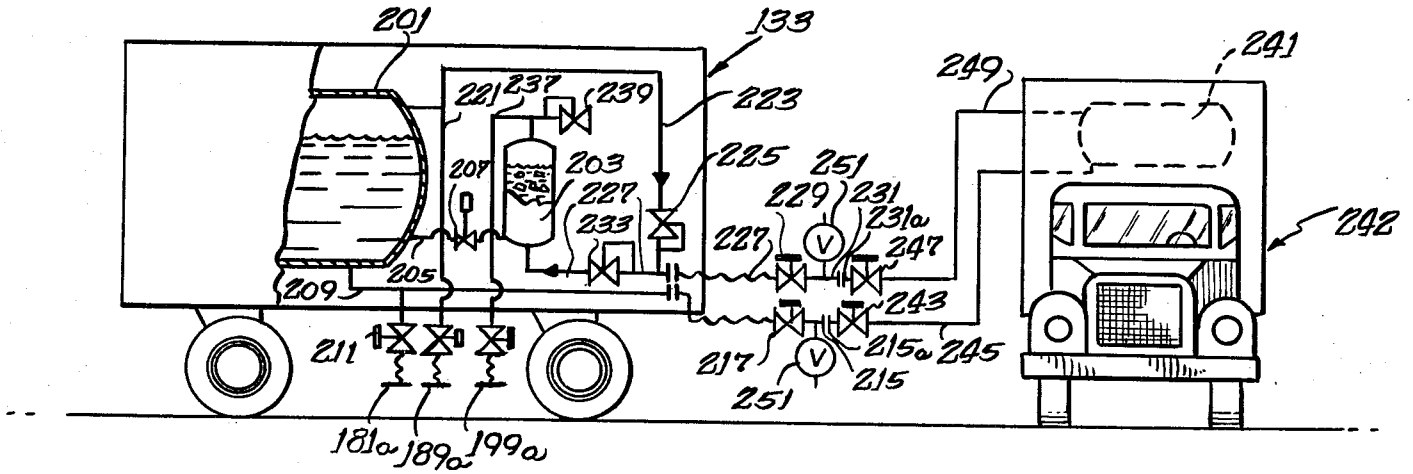

It is an object of the present invention to provide an improved method for filling tanks with relatively low pressure liquid cryogen, particularly carbon dioxide. A further object of the invention is to provide an improved system for simultaneously filling a plurality of transportable tanks such as those of a number of refrigerated vehicles, with a cyrogen, such as liquid carbon dioxide. These and other objects of the invention will be apparent from the following detailed description particularly when read in combination with the appended drawings wherein:

FIG. 1 is a diagrammatic view showing one ground support installation embodying various features of the invention; and FIGS. 2 and 3 are similar views illustrating an alternative embodiment of a ground support system.

An efficient and economical installation for supplying refrigerated trucks with low pressure liquid carbon dioxide has been created which is capable of supplying the peak demand of a number of trucks simultaneously, without the requirement of an expensive, large capacity compressor and its associated high horsepower electric motor and power supply. By creating and preserving a reservoir of carbon dioxide snow, a ready sump is provided for the carbon dioxide vapor which will be created during the time of the peak demand, and as a result the installation allows both the simultaneous filling of multiple vehicle tanks with low pressure carbon dioxide and the standby cooling of their cargo compartments with recovery of substantially all of the carbon dioxide vapor created.

Depicted in FIG. 1 is a system which is designed to store refrigerant for supply to refrigerated vehicles that employ liquid carbon dioxide for coolant. The basic refrigeration system for the vehicle is described in detail in my above-mentioned U.S. Pat. No. 4,045,972, the disclosure of which is incorporated herein by reference. The system for filling the truck storage tanks is sometimes referred to as a ground support system, and it is designed to minimize the cost of operating such an overall, carbon dioxide, vehicle refrigeration system by (1) minimizing the cost of installed equipment and (2) recovering carbon dioxide vapor for compression and reliquefication whenever feasible.

Although the vehicle refrigeration system itself can take various different forms, one representative embodiment is shown for purposes of illustration for the present application. Basically, the vehicle refrigeration system utilizes a liquid carbon dioxide storage tank 5, which may be mounted underneath the truck frame, and includes a liquid inlet line 7 that is equipped with a shut-off valve 9 and a coupling **11*a* for connection to the ground support system. A vapor return line 13 extends from an upper region of the tank 5. It includes a pressure relief valve 15 and similarly includes a shut-off valve 17 and a coupling 19*a*** for connection to the ground support system.

A liquid feed line 21 runs from a lower portion of the storage tank 5 through a shut-off valve 23 to a heat exchanger 25, which is located in the cargo compartment 27 of the vehicle. The heat exchanger 25 is of sufficient length so that all of the liquid carbon dioxide turns to vapor therein, and the vapor exits through a line 29 which includes a back pressure regulator 31 that is set to maintain a pressure of at least 65 psig in the heat exchange coil to prevent the formation of solid carbon dioxide therein. The carbon dioxide vapor flowing through the line 29 enters a gas motor 33 which is drivingly connected to a blower fan 35 that causes circulation of the atmosphere throughout the cargo compartment 27 and in particular past the heat exchanger 25. Isentropic expansion takes place in the gas motor 33 and results in both a lowering of the pressure of the vapor as well as a lowering of its temperature.

The cold vapor then passes through a second heat exchanger 37, which may be arranged so that it also lies in the circulation path of the blower 35, and advantage is thus taken of the cooling capacity of this expanded vapor. The vapor exiting from the heat exchanger 37 travels through a line 39 to a tee connection 41. One leg of the tee 41 leads to a second gas motor 43, which is drivingly connected to a second blower 45, wherein further isentropic expansion occurs. The other leg of the tee 41 connects to a branch line 47 which contains a shut-off valve 49 and leads to a coupling **51*a* for connection to an auxiliary vapor return line 53 of the ground support system. The re-cooled vapor from the second motor 43 flows through a third heat exchanger 55 which lies in the circulation path of the second blower 45. After the cooling capacity of this re-cooled vapor is extracted, it is vented to the atmosphere exteriorly of the cargo compartment 27**.

The ground support system includes a main storage vessel 61 together with a freon condenser 63 of appropriate size. A supply line 65 from a lower portion of the storage vessel 61 is directed to a tee connection 67, the left hand leg of which leads, via a solenoid-controlled valve 69 to an intermediate tank 71 which is provided with a liquid level control 73. A liquid outlet 75 from the intermediate tank 71 is branched, and each branch line includes a shut-off valve 77 and a coupling **11*b* for connection via coupling 11*a* to the liquid inlet of a selected vehicle storage tank 5. A vapor outlet line 81 of the intermediate tank 71 contains a back pressure regulator 83 which is set to maintain a predetermined pressure, e.g., 95 psig., in the intermediate tank and which thus determines the amount of expansion and pressure drop that takes place as the high pressure liquid from the main storage vessel 61 is expanded thereinto. The vapor line 81 is connected through a tee 84 to another pressure regulator 85 set at, for example, 65 psig., to a vapor inlet line 88 which leads to the bottom of a holding tank 89. The pressure regulator 85 prevents the formation of solid carbon dioxide in the lines and devices upstream thereof. The other leg of the tee 84 contains a relief valve 86 and leads to a branched line which includes pairs of shut-off valves 87 and the mating couplings 19***b*.

The holding tank 89 is supported on a balance 91, and a weight switch 93 is connected to a control system 95. When the holding tank 89 is being filled, liquid $CO_2$ flows through the right-hand line leading from the tee 67 via a solenoid-operated valve 96 until a predetermined weight is reached, which indicates that the holding tank is filled to the desired extend with high pressure liquid carbon dioxide. A vapor line 97 leads from the upper portion of the holding tank 89 and is branched to provide two parallel paths leading to a compressor 99 that is controlled by a pressure switch 101 that will cause the compressor to run whenever there is a minimum amount of vapor present.

During the initial filling of the holding tank 89, the vapor passes through a back pressure regulator 103 which may be set at about 65 psig. (which is above the triple point of carbon dioxide, i.e., about 60 psig. and −70° F.), and the compressor automatically begins to run, as pressure switch may be set for about 50 psig. The compressed vapor is raised to a pressure sufficient to cause it to flow through a return line 105 and bubble through a submerged inlet into the liquid portion of the main storage vessel 61.

As soon as the weight switch 93 indicates that the holding tank 89 has been filled with the desired amount of liquid, the control system 95 opens a solenoid-controlled valve 107 that provides a parallel path to the compressor 99 through a back-pressure regulator 109 that is set at the triple point or below, e.g., 55 psig. and thus allows the formation of solid $CO_2$. As the compressor 99 slowly lowers the pressure, first slush is created, and then eventually the entire contents of the holding tank 89 is converted to $CO_2$ snow. This takes place over a number of hours, usually during the night or some other period of low demand, and the ground system is then fully charged and ready for operation. The compressor 99 runs continuously until the entire reservoir in the holding tank 89 has turned to snow, and when the compressor 99 shuts off, the control system 95 closes the valve 107 so the pressure in the tank 89 is allowed to slowly rise to the triple point.

The ground support system is coupled to a vehicle refrigeration system via connection of appropriate couplings 11*a* and *b*, 19*a* and *b* and 51*a* and *b*. The valves 9 and 17 are opened along with appropriate valves 77 and 87, and the cold liquid $CO_2$ from the intermediate tank 71 flows into the vehicle storage tank 5 through the line 75 and the coupling 11*a*, 11*b*. Flow occurs as the result of pressure differential, and the pressure in the vehicle tank is preferably controlled by a back-pressure regulator 111 which is set a few pounds below the rgulator 83. The vapor from the tank 5 flows through the line 13 and the tee 84 where it enters the main vapor return line 81 which leads to the bottom of the holding tank 89.

Shortly after liquid $CO_2$ begins to flow from the intermediate storage tank 71, the liquid level controller 73 opens the solenoid-operated supply valve 69, via the control system 95 which also actuates the solenoid-operated valve 107 in the vapor line to open the parallel path to the compressor 99 through pressure regulator 109, which is set at about 10 psi. below pressure regulator 103. Opening of the valve 107 allows the compressor 99 to get a head start, anticipating that vapor will soon be flowing to the holding tank 89, where the latent heat to the refrigeration reservoir of solid $CO_2$ stands available to assist the compressor 99 in condensing the incoming vapor. As soon as the flow of vapor through the line 88 reaches the tank 89, melting of the $CO_2$ snow to slush begins accompanied concurrently with liquefication of the incoming vapor. The compressor is of course working to remove vapor and convert the liquid back to snow; however, a net increase in liquid in the tank occurs when the rate of vapor inflow exceeds the capacity of the compressor 99.

When it is desired to cool the cargo compartment 27 of a vehicle while the vehicle is still coupled to the ground support system, the valve 23 in the liquid feed line 21, the valve 49 and a valve 115 in the secondary vapor recovery line 53 are opened. As a result, liquid carbon dioxide at, for example, a pressure of about 90 psig. flows into the main heat exchanger 25 and vaporizes. The vapor is expanded and cooled in the first air motor 33, and then provides further cooling for the cargo compartment 27 as it passes through the second heat exchanger 37. In order to recover the carbon dioxide vapor that is being used for this standby cooling of the cargo compartment 27, the branch line 47 is utilized. Thus, the vapor from the second heat exchanger 37 is sucked through coupling 51*a*, *b* and through the auxiliary vapor recovery line 53 to a small auxiliary compressor 117, which is sized to take the vapor, that may be at about 25 psig. and raise it to a sufficient pressure, i.e., in the neighborhood of about 60–70 psig., so that it will flow through a check valve 119 and into the main vapor recovery line 88 leading to the holding tank 89. Thus, this compressed vapor is condensed to liquid by the snow or slush reservoir that has been built up in the tank; and accordingly, the system provides for standby cooling of the cargo compartments 27 of vehicles without expending liquid carbon dioxide.

As indicated by the plural couplings 11*b*, 19*b* and 51*b*, the ground support system is designed to supply liquid carbon dioxide at cold temperatures and relatively low pressure simultaneously to a plurality of vehicles. In the preferred form, all of the fluid flow is by pressure differential, and no auxiliary pumping equipment is required. As a part of the design of the system, a low temperature low pressure liquid reservoir is preferably built up in the tank 71 which is ready for prompt flow at any time to the individual vehicle tanks 5. More importantly, either during off periods or at night, the large holding tank 89 full of carbon dioxide snow is created, which then stands ready to condense the vapor which will be created during a peak time of filling individual vehicle tanks and/or cooling still coupled vehicles.

All of the foregoing is accomplished without the need for a large horsepower motor to drive a high capacity compressor, that would otherwise be needed to handle all of the vapor that would be created during peak demand periods. Instead, a relatively small sized compressor 99 can adequately handle the job because its period of operation is stretched out over a good deal of the 24-hour day. However, should a peak demand of unusually long duration occur, so that all the snow in the holding tank 89 is melted and the pressure in the tank 89 climbs past a set upper limit of about 70 psig., a spring-loaded relief valve 121 opens and vents the ground support system, as needed, to keep the pressure within the working design so as to allow the continued filling of vehicle tanks 5 and the standby cooling of the cargo compartments 27. Should such venting occur, the control system 95 senses the condition via the weight switch 93, after an "at rest" position is later reached, and automatically refills the tank 89 to the desired level.

Depicted in FIGS. 2 and 3 is a generally similar ground support system 131 for filling transportable tanks, particularly those carried by a vehicle. The system employs a movable or transportable satellite unit 133 which can be wheeled into position adjacent a truck or trucks. Thus, the satellite system provides a greater degree of flexibility in that the refrigerated trucks need not be moved to a precise location where the cryogen lines are available, as in the system illustrated in FIG. 1, but instead, the satellite unit 133 can be moved to a position adjacent the vehicle so as to coordinate filling of the vehicle tank with the loading of the refrigerated cargo.

The stationary portion of the ground support system 131 includes a high-pressure liquid carbon dioxide storage vessel 135 with which there is associated one or more freon condensers or other refrigeration units 137 of appropriate size. A liquid line 139 leads from a lower portion of the storage vessel through a remote-controlled valve 141 to an intermediate tank 143. A liquid level control 145 on the tank controls flow through the valve 141 and assures that the level of liquid in the intermediate tank 143 remains between desired limits. A pair of liquid lines 147,149 exit from lower locations in the intermediate tank 143, and a vapor line 151 is provided at the top of the tank.

The vapor line 151 includes a relief valve 153 and a back pressure regulator 155 and is connected to the main vapor return line 157 which leads to a compressor 159. The compressor discharge is connected via a vapor line 161 to a perforated pipe 163 located in the bottom portion of the main storage vessel 135 so that the compressed vapor is normally bubbled into the liquid $CO_2$ in the vessel, as depicted in FIG. 2. However, a branch line 165 is provided along with a pressure regulator 167 which opens should the pressure in the vessel, as by prolonged operation of the condenser 137, drop below a desired value, for example 310 psig, so that compressed vapor is then preferentially returned to the ullage in the main storage vessel 147.

The liquid line 147 from the intermediate tank 143 leads to a holding tank 169 through a remote-controlled valve 171. The holding tank 169 is designed to contain a desired amount of carbon dioxide slush or carbon dioxide snow which will serve as a refrigeration reservoir. A vapor line 173 exits from the upper end of the holding tank 169 and connects to the main vapor return line 157 leading to the compressor. The holding tank 169 may be equipped with a liquid level control or associated with a scale balance or some other type of weight switch, as hereinbefore described.

In operation, the high pressure storage vessel 135 normally maintains liquid carbon dioxide in equilibrium with vapor at a pressure of about 310 to 315 psig. The intermediate vessel 143 may be set to hold liquid $CO_2$ at a substantially lower pressure, for example 90 to 150 psig. The back pressure regulator 155 is set to maintain the desired pressure in the intermediate tank 143, and the pressure relief valve 153 is set at, for example, 20 psi above the back pressure regulator setting. Accordingly, the intermediate tank 143 will be filled with liquid $CO_2$ from the main storage vessel 135 through the line 139, and the vapor that is generated as a result of the drop in pressure is drawn by the suction of the compressor 159 through the lines 151 and 157 and returned to the main storage vessel.

When the control system 175 opens the valve 171, liquid $CO_2$ at, for example, 100 psig flows into the holding tank 169 where its pressure is further decreased. The pressure within the holding tank 169 is regulated by a back pressure regulator 177 in the vapor outlet line 173, and this may be set at just slightly below the triple point. The additional vapor which is created as the 100 psig liquid drops to the triple point, i.e., about 60 psig, is withdrawn by the compressor 159. As the pressure reaches the triple point of the cryogen, further withdrawal of vapor causes the creation of solid cryogen. After most or all of the liquid remaining in the holding tank 169 has been turned to solid $CO_2$ snow, an additional fill or fills with liquid $CO_2$ may be made until the desired amount of snow or slush is created, as explained above.

The remaining liquid line 149 from the intermediate tank 143 contains a valve 179 and leads to a coupling 181. A branch vapor line 183 from the main vapor return line 157 leads through a pressure regulator 185 and a valve 187 to a coupling 189. This line 183 itself is branched, and its branch 191 leads through a check valve to the bottom of the holding tank 169. A further line 193 from the bottom of the holding tank 169 leads through a pump 195 to a connection with the liquid line 147 from the intermediate tank 143, and it is used to pump liquid cryogen from the holding tank 169 should this be desired, as in the case when the holding tank 169 is originally filled with a large amount of slush having a high solids content and subsequent condensation of vapor creates a potential for overfilling. Still another line 197 is connected to the main vapor line 157 at a location between the holding tank vapor outlet pressure regulator 177 and the suction side of the compressor 159, and this line leads through a valve 198 to a coupling 199.

The satellite unit 133 contains mating couplings **181*a*, 189*a* and 199*a* which respectively connect with those couplings described above when the satellite unit is being filled, as depicted in FIG. 2. The satellite unit 133 includes a low-pressure supply tank 201 which becomes filled to a desired level with liquid $CO_2$ at a pressure about 10 to 20 psig below that of the intermediate tank 143. The drawings are diagrammatic and not to scale as, for example, the intermediate tank 143 would likely be larger than the supply tank 201. Coupled with the liquid supply tank 201 is a satellite holding tank 203 which, although not nearly as large as the main holding tank, will contain $CO_2$ snow or slush formed in the same general manner as described above with respect to the main holding tank 169. A liquid flow line 205 containing a remote-controlled valve 207 interconnects the supply tank 201 and the satellite holding tank 203. A liquid line 209 from a valve 211 connected to the coupling 181*a* leads to the bottom of the liquid supply tank 201, and a branch line 213 leads to a coupling 215 and also contains a shut-off valve 217 (see FIG. 3**).

The coupling **189*a* is connected through a valve 219 to a vapor line 221 that leads to the vapor portion of the supply tank 201. A branch 223 of the vapor line leads through a pressure regulator 225 to another vapor line 227. The line 227 is connected at one end through a valve 229 to a coupling 231 and at its other end through a pressure regulator 233** to a lower location in the satellite holding tank 203. The coupling 199*a* leads through a valve 235 to a vapor line 237 that is connected to the top of the satellite holding tank 203 and contains a relief valve 239 which is set, for example, about 20 psi above the triple point.

With the satellite unit 133 connected to the stationary portion of the ground support system, as depicted in FIG. 2, liquid will flow from the intermediate tank 143 into the supply tank 201 when the valves associated with the couplings 181, 181*a*, 189 and 189*a* are open. Normally, the supply tank 201 will be under pressure; however, should the pressure have dropped in the supply tank, the pressure regulator 185 in the vapor line 183, which may be set, for example, at about 60 psig, will open. This initially pressurizes the tank 201 so that the liquid $CO_2$ will not flash to snow in the fill line 209, but the pressure is not high enough to open the check valve in the line 191. The vapor from the tank 201 which is displaced by the incoming liquid exits through the vapor line 221 and the coupling 189,189*a*. The higher pressure of this exiting vapor causes the pressure regulator 185 to close, and thus this returning vapor is routed via the line 191 and the check valve to the holding tank 169 where it is condensed by melting solid $CO_2$.

At the same time, the valve 207 in the liquid line 205 will be open so that liquid $CO_2$ will flow from the tank 201 to the satellite holding tank 203 as controlled by either a liquid level switch or a weight control switch (not shown). The suction side of the compressor 159 is connected through the coupling 199,199*a* to the top of the holding tank via the line 237, and it will attempt to reduce the pressure in the satellite holding tank 203 to just below the triple point so as to create solid $CO_2$ therein, similar to the manner in which the solid $CO_2$ *reservoir is created in the main holding tank* 169.

When the satellite unit 133 is fully charged, it will have sufficient liquid $CO_2$ in the supply tank 201 to, for example, fill the vehicle tanks 241 of five trucks 242. The satellite holding tank 203 will be appropriately sized and will contain an amount of solid $CO_2$ which will be at least sufficient to condense the vapor that will normally be generated from filling the same number of vehicle tanks, i.e., five. When charging is complete, the associated valves are closed and the three couplings 181,189 and 199 are disconnected, rendering the satellite unit 133 ready to be moved to a location where the transportable tank 241 of one or more trucks 242 can be filled. Although only a single pair of couplings 215, 231 are illustrated, it should be understood that, as depicted in respect of FIG. 1, additional pairs of couplings could be provided. Once the satellite unit is decoupled from the stationary section of the ground support system 131, it is of course ready to service another satellite unit. Accordingly, at a large installation, two or three or even more satellite units 133 could be charged and made ready during the slow period when most of the trucks are out making deliveries or during evening hours. Likewise, the snow reservoir in the main holding tank 169 can be automatically replenished during the night when power costs are relatively low.

FIG. 3 depicts the hook-up of the satellite unit 133 to a refrigerated delivery truck 242. The coupling 215 is joined to a mating coupling 215*a* on the liquid side, which connects though a valve 243 to a line 245 leading to the vehicle tank 241 which is located above the cab. The coupling 231 is joined to a mating coupling 231*a* which connects through a valve 247 to a vapor line 249 that connects to the head space of the vehicle tank 241. The vehicle tank is filled to the desired extent, as controlled by the operator, with liquid cryogen at a slightly lower pressure than that of the supply tank 201, which pressure is controlled by the valving arrangement in the satellite unit 133.

The illustrated system is designed to fill the vehicle tank 241 with liquid $CO_2$ at a low pressure, e.g., 75 psig or below, via liquid flow by differential pressure from the supply tank which is maintained at sufficiently higher pressure that there will be enough pressure head to fill the tank 241 in a reasonable time period. As an example, it is assumed it is desired to fill the tank 241 with liquid $CO_2$ at about 70 psig. The two coupling connections are made, and the valves 229 and 247 are opened on the vapor side. If the pressure within the vehicle tank 241 should be below, for example, 60 psig, the pressure regulator 225 will open, and sufficient vapor from the supply tank 201 will flow into the vehicle tank 241 through the lines 223 and 249 to raise its pressure to this desired minimum. The liquid line valves 217 and 243 are then opened, and liquid $CO_2$ at, for example, 90 psig will flow through the line 209 and the line 245 into the vehicle tank 241. Flow can be either manually controlld by the valve 207, or a suitable level control can be provided on the transportable tank 241 that connects to the valve 243 or some other valve in the line. So long as the pressure in the vapor line 249 from the vehicle tank 241 is above about 70 psig, the regulator allows the vapor which is being displaced by the incoming liquid cryogen to flow through the line 227 into the bottom of the satellite holding tank 203, where it is condensed by melting the solid $CO_2$. Thus, the setting of the back pressure regulator 233 effectively determines the pressure at which the vehicle tank 241 will be filled.

When filling is complete, the four valves 217, 229, 243 and 247 adjacent the couplings 215 and 231 are closed, and two small petcocks 251 are opened to bleed the couplings to atmospheric pressure. Similar petcocks would be associated with the couplings 181, 189, 199, but are not shown. The petcocks 251 are also used to purge the coupling system in making the connections, before all of the valves are opened, to minimize the entry of air into the $CO_2$ system. As soon as the satellite unit 133 is disconnected from one truck 242, it is ready to be moved in position adjacent another truck and connected into filling relationship therewith. Accordingly, the mobile satellite unit 133 allows transportable liquid cryogen tanks to be filled, either simultaneously or sequentially, without the expenditure of cryogen vapor which is recovered by condensation in the satellite holding tank 203. By providing a small pump (not shown) which can be connected into the liquid line 209, liquid cryogen can be pumped from the tank 241 of a truck that will be out of service for some time. Ultimately, the satellite unit 133 is reconnected to the stationary section of the ground support system 131 where the supply tank 201 is refilled and the holding tank 203 is retransformed to a solid $CO_2$ refrigeration reservoir by removal of vapor by the compressor 159. The mobile satellite unit 133 is similarly capable of being completely charged without the expenditure of cryogen vapor, which is recovered by the solid $CO_2$ refrigeration reservoir in the main holding tank 169 and by means of the compressor 159.

The ground support systems illustrated provide relatively low cost installations, from an equipment stand-point, yet they are extremely economical to use because they stand ready to supply cold liquid $CO_2$ to the tanks of trucks, trailers, railroad boxcars, containerized shipping units and the like, with substantially no expenditure of carbon dioxide vapor during the filling of the tanks, or even during standby cooling of some vehicle cargo compartments.

Although the invention has been described with regard to certain preferred embodiments, it should be understood that various modifications as would be obvious to one having the ordinary skill in the art may be made without departing from the scope of the invention which is defined solely by the appended claims. For example, although the reservoir of solid cryogen is preferably formed by filling the holding tank with liquid cryogen and reducing the pressure to cause evaporation at about the triple point, alternatively the liquid cryogen could be turned to slush by cooling the holding tank using an auxiliary mechanical or other refrigeration system.

Various of the features of the invention are emphasized in the claims which follow.

What is claimed is:

1. A method for supplying tanks with liquid $CO_2$, which method comprises creating a low-temperature coolant reservoir of solid carbon dioxide in a chamber at the triple point pressure or below, providing a source of liquid $CO_2$ at a higher pressure than said triple point pressure, supplying said higher pressure liquid $CO_2$ to a tank, removing $CO_2$ vapor from the tank as said higher pressure liquid $CO_2$ is being supplied and transferring said removed $CO_2$ vapor from the tank to said chamber and condensing said vapor by melting said solid $CO_2$ in said reservoir.

2. A method in accordance with claim 1 wherein said low-temperature coolant reservoir is created from liquid $CO_2$ by supplying said liquid $CO_2$ to said chamber from a high-pressure storage vessel system and lowering the pressure in the chamber, removing $CO_2$ vapor which is formed in the chamber and compressing said removed vapor, and returning said compressed $CO_2$ vapor to the storage vessel system.

3. A method in accordance with claim 1 wherein a pool of intermediate pressre liquid $CO_2$ is established as said source by withdrawing liquid $CO_2$ from a high pressure storage vessel system and lowering the pressure thereof and wherein liquid from said intermediate pool is supplied to the tank at a still lower pressure.

4. A method in accordance with claiam 3 wherein said liquid $CO_2$ is supplied to the tank at a pressure between about 125 psig and the triple point pressure.

5. A method in accordance with claim 4 wherein a plurality of transportable tanks are simultaneously supplied with liquid $CO_2$ and wherein vapor from the tanks is combined and transferred to said chamber.

6. Apparatus for supplying a liquid cryogen to a transportable tank, which apparatus comprises a chamber, means for creating a low-temperature coolant reservoir of solid cryogen in said chamber by reducing the pressure of liquid cryogen to at least about the triple point pressure, a compressor for removing cryogen vapor which is formed as a result of said formation of solid cryogen, means for condensing said compressed cryogen vapor, a source of liquid cryogen at a relatively high pressure, means for supplying the tank with liquid cryogen from said source, means for removing cryogen vapor from said tank as liquid cryogen is supplied and transferring said removed cryogen vapor from the tank to said chamber where it condenses by melting solid cryogen.

7. Apparatus in accordance with claim 6 wherein said liquid supplying means includes a plurality of disconnectable couplings having valve means associated with each of said couplings so that a plurality of transportable tanks can be simultaneously supplied with liquid cryogen and wherein said vapor transferring means includes a plurality of disconnectable couplings and valve means associated with each of said couplings.

8. Apparatus in accordance with claim 6 wherein a high pressure liquid cryogen storage vessel is provided to which said compressed cryogen vapor is fed, wherein an intermediate vessel which serves as said souce is provided between said high-pressure storage vessel and said liquid cryogen supply means, and wherein means is associated with said intermediate tank for maintaining a preselected pressure therein which is below the pressure of said storage vessel and above the pressure at which the tank is to be filled so that liquid cryogen flow occurs by pressure differential.

9. Mobile apparatus for supplying liquid cryogen to a transportable tank, which apparatus comprises a chambler containing a low-temperature coolant reservoir of solid cryogen at the triple point pressure or below, a supply tank holding liquid cryogen at a higher pressure, means, including coupling means, for transferring liquid cryogen from said supply tank to a transportable tank mounted on a vehicle and means, including coupling means, for removing cryogen vapor from said tank as liquid cryogen is being supplied for transferring said removed cryogen vapor from the tank to the chamber where is condenses by melting solid cryogen.

10. Apparatus in accordance with claim 9 wherein said vapor transferring means includes a line leading to the ullage of said supply tank, which line includes a pressure regulator which remains open so long as the pressure of the transportable tank is below a predetermined pressure which is above the triple point pressure.

* * * * *

Disclaimer and Dedication 4,211,085.—*Lewis Tyree, Jr.,* Oak Brook, Ill. SYSTEMS FOR SUPPLYING TANKS WITH CRYOGEN. Patent dated July 8, 1980. Disclaimer and Dedication filed Oct. 20, 1980, by the inventor.

Hereby disclaims and dedicates all claims of said patent.

[*Official Gazette October 5, 1982.*]